US012714168B2

(12) United States Patent
Kelly et al.

(10) Patent No.: US 12,714,168 B2
(45) Date of Patent: Aug. 25, 2026

(54) MOISTURE-WICKING ARTICLE OF HEADWEAR

(71) Applicant: NIKE, Inc., Beaverton, OR (US)

(72) Inventors: Erika R. Kelly, Milwaukie, OR (US); Kraig Nelson, Beaverton, OR (US); Aaron Reimer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/593,052

(22) Filed: Mar. 1, 2024

(65) Prior Publication Data

US 2024/0197011 A1 Jun. 20, 2024

Related U.S. Application Data

(60) Continuation of application No. 17/875,100, filed on Jul. 27, 2022, now Pat. No. 11,944,142, which is a division of application No. 16/787,205, filed on Feb. 11, 2020, now Pat. No. 11,432,603.

(60) Provisional application No. 62/867,586, filed on Jun. 27, 2019.

(51) Int. Cl.
*A41D 20/00* (2006.01)
*A42B 1/04* (2021.01)

(52) U.S. Cl.
CPC ..... *A41D 20/00* (2013.01); *A42B 1/04* (2013.01)

(58) Field of Classification Search
CPC ..... A42B 1/008; A42B 1/0189; A42B 1/04; A42B 1/205; A42B 1/206; A41D 20/00; A41D 20/005; A41D 31/125; A42C 5/02
USPC .... 2/171, 171.1, 171.4, 171.5, 171.6, 171.7, 2/171.8, 181, 181.2, 181.4, 181.6, 181.8, 2/182.1, 182.3, 182.8, 209.4, 200.1
See application file for complete search history.

(56) References Cited

U.S. PATENT DOCUMENTS

| | | | |
|---|---|---|---|
| 960,251 | A | 6/1910 | Beenken |
| 1,495,895 | A | 5/1924 | Isaac et al. |
| 1,528,220 | A | 3/1925 | Leighton |
| 2,013,088 | A | 9/1935 | Drueding |
| 2,582,492 | A | 1/1952 | Lev |
| 2,994,090 | A | 8/1961 | Ostwald |

(Continued)

FOREIGN PATENT DOCUMENTS

| | | | |
|---|---|---|---|
| AT | 13771 | B | 10/1903 |
| DE | 9307279 | U1 | 7/1993 |

(Continued)

OTHER PUBLICATIONS

"Gore Running Wear Women's Air Lady Cap", Retrieved from Internet URL: www.amazon.com, on Mar. 5, 2019, pp. 5.

(Continued)

*Primary Examiner* — Matthew R Marchewka

(74) *Attorney, Agent, or Firm* — Shook, Hardy & Bacon L.L.P.

(57) ABSTRACT

A moisture-wicking article of headwear includes a first layer of material formed from a polyester yarn, a second layer of material formed from a polyester yarn, and an absorbent layer positioned between the first layer of material and the second layer of material at a front of the article of headwear. The article of headwear is configured to temporarily store perspiration produced by a wearer's forehead area and transport the perspiration to the sides and back of the article of headwear where it can subsequently evaporate or be harmlessly released.

19 Claims, 5 Drawing Sheets

(56) References Cited

U.S. PATENT DOCUMENTS

| | | | | |
|---|---|---|---|---|
| 3,578,736 | A | 5/1971 | Dootson | |
| 3,766,565 | A | 10/1973 | Cozzens | |
| 3,780,382 | A | 12/1973 | Boden | |
| 4,451,934 | A | 6/1984 | Gioello | |
| 4,547,903 | A | 10/1985 | Brown et al. | |
| 4,776,042 | A * | 10/1988 | Hanson | A42B 1/008 2/909 |
| 4,856,116 | A | 8/1989 | Sullivan | |
| D317,523 | S | 6/1991 | Smith | |
| 5,058,210 | A | 10/1991 | Tivis | |
| 5,146,630 | A * | 9/1992 | Richard | A41D 20/005 2/171.2 |
| 5,313,668 | A | 5/1994 | Bogan et al. | |
| 5,327,585 | A * | 7/1994 | Karlan | A42C 5/04 2/209.13 |
| 5,359,733 | A | 11/1994 | Brannon et al. | |
| 5,377,360 | A | 1/1995 | Fleitman | |
| 5,471,683 | A | 12/1995 | Moretz et al. | |
| 5,481,760 | A | 1/1996 | Wood, Jr. | |
| 5,566,395 | A | 10/1996 | Nebeker | |
| 5,572,745 | A * | 11/1996 | Mainus | A41D 23/00 2/171.2 |
| 5,630,230 | A | 5/1997 | Fujino et al. | |
| 5,715,540 | A * | 2/1998 | Cho | A42B 1/22 2/195.3 |
| D406,442 | S | 3/1999 | Allen | |
| 5,887,276 | A | 3/1999 | Lee | |
| 5,887,284 | A | 3/1999 | Simmons | |
| 5,915,532 | A | 6/1999 | Williams | |
| 5,956,759 | A | 9/1999 | Benedict | |
| D423,196 | S | 4/2000 | White | |
| 6,199,213 | B1 * | 3/2001 | Whang | A42B 1/22 2/181 |
| 6,205,590 | B1 | 3/2001 | Gorman | |
| 6,546,563 | B2 | 4/2003 | Young | |
| 6,564,390 | B2 * | 5/2003 | Vernon | A41D 20/00 2/181 |
| 6,571,396 | B1 | 6/2003 | Yan | |
| 6,658,664 | B1 * | 12/2003 | Verhoeven | A42B 1/22 2/12 |
| 7,278,173 | B2 | 10/2007 | Turner | |
| 7,497,097 | B2 | 3/2009 | Herr | |
| 7,559,094 | B2 | 7/2009 | Solari | |
| D623,831 | S | 9/2010 | Parsons et al. | |
| D635,743 | S | 4/2011 | Johnson | |
| 9,119,432 | B2 | 9/2015 | Fleischmann | |
| 9,456,650 | B1 * | 10/2016 | Boyce | A42C 5/02 |
| 9,554,605 | B2 | 1/2017 | Burnet et al. | |
| 9,999,269 | B2 | 6/2018 | Arkusz | |
| D827,990 | S | 9/2018 | Lacy et al. | |
| 10,111,482 | B2 | 10/2018 | Brandt et al. | |
| 10,123,581 | B2 | 11/2018 | Lacy et al. | |
| D837,491 | S | 1/2019 | Lacy et al. | |
| D841,944 | S | 3/2019 | Lacy et al. | |
| 2003/0177565 | A1 * | 9/2003 | Park | A42C 5/02 2/181.4 |
| 2004/0006807 | A1 | 1/2004 | Wang | |
| 2004/0093655 | A1 * | 5/2004 | Cho | A42B 1/22 2/209.3 |
| 2004/0237599 | A1 | 12/2004 | Kondou et al. | |
| 2005/0028246 | A1 | 2/2005 | Lee | |
| 2005/0155135 | A1 * | 7/2005 | Cho | A42C 5/02 2/172 |
| 2005/0160518 | A1 * | 7/2005 | Cho | A42B 1/22 2/181 |
| 2006/0048274 | A1 * | 3/2006 | Lee | A42C 5/00 2/181 |
| 2006/0277951 | A1 * | 12/2006 | Herr | D04B 21/12 66/196 |
| 2007/0056078 | A1 | 3/2007 | Tseng | |
| 2007/0083982 | A1 | 4/2007 | Cho | |
| 2008/0086793 | A1 | 4/2008 | Higgins | |
| 2009/0183300 | A1 | 7/2009 | Cho | |
| 2010/0138980 | A1 | 6/2010 | Duda et al. | |
| 2011/0072555 | A1 | 3/2011 | Asiatico | |
| 2011/0302695 | A1 * | 12/2011 | Cho | A42B 1/22 2/181 |
| 2013/0185843 | A1 | 7/2013 | Rahm | |
| 2015/0113705 | A1 | 4/2015 | Kim et al. | |
| 2017/0188644 | A1 | 7/2017 | Foresta et al. | |
| 2018/0220728 | A1 | 8/2018 | Mcdade et al. | |
| 2020/0383420 | A1 * | 12/2020 | Kronenberger | A42B 1/002 |
| 2020/0404996 | A1 | 12/2020 | Kelly et al. | |

FOREIGN PATENT DOCUMENTS

| | | | |
|---|---|---|---|
| FR | 3031882 | A1 | 7/2016 |
| JP | 5344470 | B2 | 11/2013 |
| KR | 10-2010-0088659 | A | 8/2010 |
| WO | 90/06698 | A1 | 6/1990 |

OTHER PUBLICATIONS

"Halo Headbands Sweatband Sport Hat", Retrieved from Internet URL: www.amazon.com, on May 15, 2014, p. 8.
"Honeywell Black Fibre-Metal, Terry Cloth Evaporative Cooling Sweatband", Airgas, Feb. 25, 2019, pp. 2.
"La Sportiva Shield Cap", Retrieved from Internet URL: www.backcountry.com, on Dec. 1, 2017, pp. 6.
"Nike AeroBill", Retrieved from Internet URL: www.nike.com, on Jun. 25, 2017, pp. 2.
"No Sweat Baseball Hat & Batting Helmet Liner-Absorbs Dripping Sweat/Moisture Wicking Sweatband, Prevent Sweat Stains/Ultimate Hat Saver", Jun. 19, 2017, pp. 9.
"No Sweat Disposable Hard Hat Sweatband/Liner/Sweat Absorber", May 31, 2018, pp. 10.
"OccuNomix Snap-On Hard Hat Sweatband, Beat The Heat, Blue, 6 Count", May 25, 2012, pp. 8.
"Run-Thru Hat", Retrieved from Internet URL: www.brooksrunning.com, on Dec. 21, 2017, pp. 11.
"Sprinter Cap", Retrieved from Internet URL: www.sundayafternoons.com, on Apr. 11, 2016, pp. 4.

* cited by examiner

MOISTURE-WICKING ARTICLE OF HEADWEAR

CROSS-REFERENCE TO RELATED APPLICATIONS

This application is a continuation of U.S. application Ser. No. 17/875,100, filed Jul. 27, 2022, and entitled "Moisture-Wicking Article of Headwear," now issued as U.S. Pat. No. 11,944,142, which is a divisional application of U.S. application Ser. No. 16/787,205, filed Feb. 11, 2020, and entitled "Moisture-Wicking Article of Headwear," now issued as U.S. Pat. No. 11,432,603, which claims the benefit of priority of U.S. Provisional Application No. 62/867,586, filed Jun. 27, 2019, and entitled "Moisture-Wicking Article of Headwear." The entireties of the aforementioned applications are incorporated by reference herein.

TECHNICAL FIELD

Aspects herein relate to a moisture-wicking article of headwear.

BACKGROUND

Athletes playing sports such as tennis often wear stand-alone sweatbands or hats incorporating a sweatband where the sweatband is formed solely from an absorbent material such as cotton. Although these materials absorb perspiration, they lack the ability to wick perspiration away from, for instance, the eye area of the athlete and often become saturated so that they become ineffective in absorbing additional perspiration.

BRIEF DESCRIPTION OF THE DRAWINGS

Examples of aspects herein are described in detail below with reference to the attached drawings figures, wherein.

DETAILED DESCRIPTION

Figure 1:
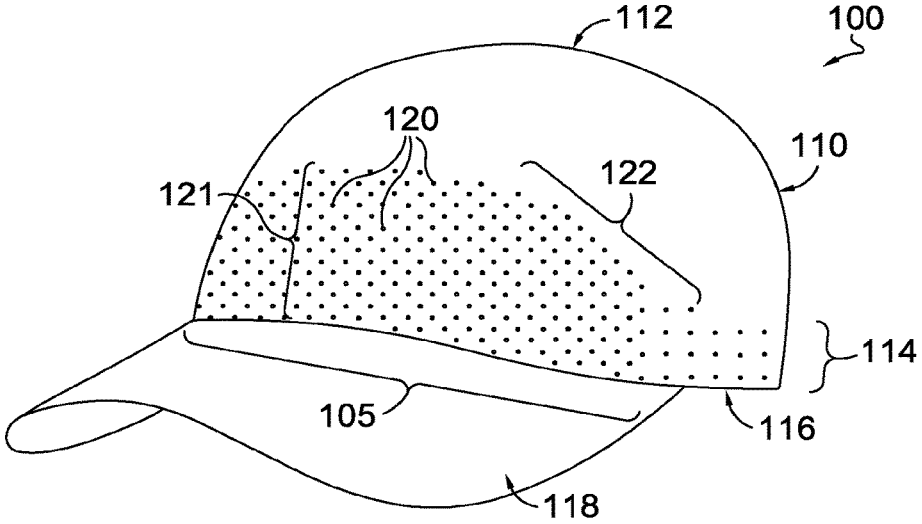
FIG. 1 illustrates a front perspective view of an example article of headwear in the form of a cap having an integrated sweatband in accordance with aspects herein.
Figure 2:
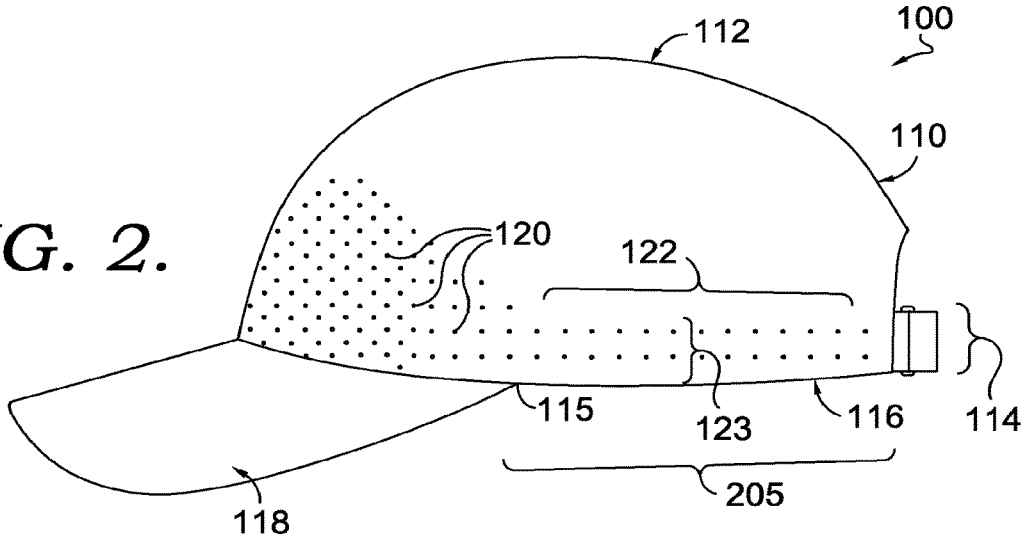
FIG. 2 illustrates a first side view of the article of headwear of FIG. 1 in accordance with aspects herein.
Figure 3:
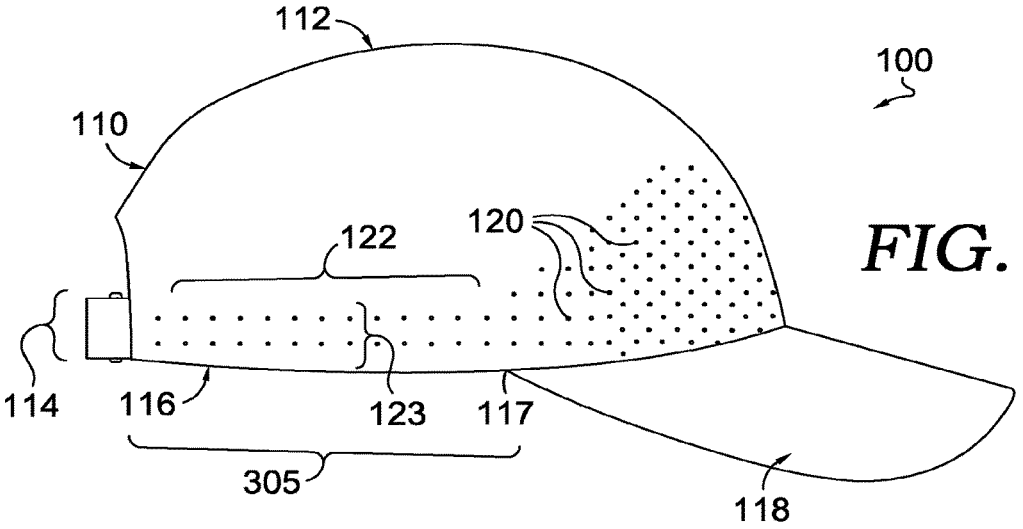
FIG. 3 illustrates a second side view of the article of headwear of FIG. 1 in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Traditional articles of headwear that are worn during athletic activities typically lack a mechanism for both absorbing perspiration produced by, for instance, the forehead of a wearer and moving the perspiration away from the wearer's eyes. Aspects herein provide for an article of headwear, such as, for example, a stand-alone sweatband or a cap or visor having an integrated sweatband, that wicks moisture, such as perspiration, from a forehead area of a wearer and stores the moisture at a front portion of the sweatband thereby protecting the wearer's eyes. The sweatband is configured to subsequently transport the moisture to the sides and/or back of the sweatband where it can either evaporate or be harmlessly released along the sides or back of the wearer's head and away from the wearer's eyes.

At a high level, aspects herein are directed to a sweatband that includes a first layer of material and a second layer of material extending along the front, the sides, and the back of the sweatband. The sweatband also includes an absorbent layer in face-sharing contact with and positioned between the first and second layers of material at the front of the sweatband. In various aspects, the absorbent layer spans only a front portion of the sweatband and does not extend along the sides and the back of the sweatband. Thus, at the sides and the back of the sweatband, the first and second layers of material are in direct face-sharing contact with each other. The combination of the two-layer construction and the three-layer construction allows perspiration collected in the sweatband to be moved and/or wicked away from the front of the sweatband toward the sides and back of the sweatband, preventing oversaturation at the front of the sweatband and subsequent dripping of perspiration into the wearer's eyes and face.

In example aspects, the first and second layers of material are formed of a wicking material, such as a polyester material, having surfaces positioned adjacent to each other at different areas of the sweatband to form a bi-layered construction. The two layers extend continuously and uninterrupted around the front, the sides, and the back of the sweatband. The use of polyester yarns, which have a low moisture regain, to form the first and second layers of material assist in the movement of moisture, such as perspiration, away from a wearer's skin, through the layers, and to the environment using, for example, capillary action (also known as wicking) between the individual polyester filaments that make up the polyester yarns as well as capillary action between the yarns themselves.

In example aspects, the absorbent layer may be a spacer textile although other materials are contemplated herein such as, for example, cotton, foam, superabsorbent polymers, wool, and the like. Perspiration produced by the forehead of the wearer is transported to the spacer textile by the polyester layer in contact with the wearer's forehead. The perspiration is then stored or trapped in the spaces between the tie yarns that connect the different layers of the spacer textile thus helping to prevent the perspiration from traveling down the wearer's face and contacting the wearer's eyes. The perspiration stored in the spacer textile may then be wicked to the sides and the back of the sweatband by way of the first and second layers of material. When transported to the sides and back of the sweatband, the perspiration may evaporate through contact with ambient air, or the perspiration may be harmlessly released from the first and second layers of material along the sides of the wearer's face and away from the wearer's eyes. Evaporation may be enhanced through use of optional perforations formed in the first and second layers of material which allow the ambient air to circulate through the first and second layers of material.

In example aspects, the front of the sweatband extends a first distance from a lower margin or edge of the sweatband, and the sides and back of the sweatband extend a second distance from the lower margin or edge of the sweatband, where the first distance is greater than the second distance. By configuring the sweatband as described, a greater surface area for absorbing perspiration is provided at the front of the sweatband which is in contact with, for instance, the wearer's forehead area. This, in turn, may help to prevent perspiration produced by the wearer's forehead area from dripping and contacting the sensitive eye area of the wearer.

In one example aspect, the sweatband may be integrated into, for example, a cap or visor. In this aspect, the sweatband is secured to an inner-facing surface of a lower portion of the cap or to an inner-facing surface of the visor and extends along the front, sides, and back of the cap or visor. The cap or visor may optionally include a plurality of perforations arranged in a perforation pattern that extends along the front, the sides, and the back of the cap or visor. In some aspects, the perforation pattern extends a first distance from a lower margin or edge of the cap or visor at the front of the cap or visor and extends a second distance from the lower margin along the sides and the back of the cap or visor, where the first distance is greater than the second distance. Thus, in some example aspects, the perforation pattern on the cap or visor may correspond to the shape of the underlying sweatband enabling air that is channeled through the perforations on the cap or visor to come into direct contact with the sweatband helping to facilitate evaporation of any perspiration present in the sweatband.

As used herein, the term "article of headwear" encompasses any structure configured to be worn on the head of a wearer. Thus, the article of headwear may comprise a stand-alone sweatband or the article of headwear may include any number of constructions having an integrated sweatband such as a cap with a crown and a bill (i.e., a baseball cap), a visor (i.e., a cap without a crown portion), a beanie, a beret, a bowler or derby, a fedora, a hard hat, a sun hat, and the like. In some example aspects, such as when the article of headwear is in the form of a cap, the article of headwear includes a crown. The term "crown" as used herein, means the portion of the article of headwear configured to be worn over the top portion of the wearer's head.

Positional terms used when describing the article of headwear such as front, sides, back, lower portion, superior, inner-facing surface, and the like are with respect to the article of headwear being worn as intended with the wearer standing upright such that the lower portion of the article of headwear is configured to be positioned generally above the eyes of the wearer, the inner-facing surface of the article of headwear is configured to be positioned adjacent to a skin surface of the wearer, and the apex of, for instance, the crown is configured to be positioned adjacent to an apex or top portion of the wearer's head. As used herein, the front of the article of headwear is configured to at least partially cover the forehead of the wearer when the article of headwear is worn, the sides of the article of headwear are configured to at least partially cover the sides of the wearer's head when the article of headwear is worn, and the back of the article of headwear is configured to at least partially cover the back of the wearer's head when the article of headwear is worn. The term "face-sharing contact" as used herein means a surface of a first material that is in contact or near contact with a surface of a second material.

When describing that a layer of material, such as the layers forming the sweatband, are formed from a polyester yarn, it is contemplated herein that the layers may be formed of at least about 60% polyester, at least about 70% polyester, at least about 80% polyester, at least about 90% polyester, or about 100% polyester. Other yarns used to form the sweatband may include elastomeric yarns such as spandex or elastane. As used herein, the term "about" means within ±5% of a designated value. As is known to those skilled in the art of textiles, polyester yarns have a low moisture regain typically in the range of from about 0.4% to about 0.6%, where moisture regain is defined as the percentage of moisture an oven-dry fiber or filament will absorb from the air when at standard temperature and relative humidity. Polyester yarns and/or polyester filaments generally do not absorb as much moisture as, for instance, cotton yarns. Thus, when moisture comes into contact with a textile formed from polyester yarns, the moisture may move through the textile by way of capillary action or wicking between the polyester filaments that make up the polyester yarns and/or between the polyester yarns themselves instead of being absorbed by the polyester yarns.

The term spacer textile as used herein is meant to encompass warp knit or weft knit spacer textiles as is known in the art of textiles. Spacer textiles are generally formed by utilizing at least one tie yarn to interknit first and second layers of the textile. More specifically, each of the first layer and the second layer may be knit separately, and the tie yarn(s) is used to connect the first layer and the second layer. For instance, the tie yarns may have "loop" portions that extend into each of the first layer and the second layer where the loop portions are interlooped with yarns in the first layer and the second layer to connect the two layers. In general, the longitudinal length of the tie yarn(s) is oriented perpendicular, or near perpendicular, to the planar surfaces of both the first and second layers.

The term "perforation" as used herein means a hole or aperture extending through a layer of material (extending from a first surface to a second surface) and having a minimum diameter such as, for example, about 0.8 mm to about 0.9 mm, or about 1.0 mm. The perforation may be formed by modifying the knitting or weaving process used to form the layer of material, or the perforation may be formed in a post-knitting or weaving step using, for instance, laser cutting, water jet cutting, die cutting, and the like.

Unless otherwise noted, all measurements provided herein are measured at standard ambient temperature and pressure (25 degrees Celsius or 298.15 K and 1 bar) with the article of headwear in a resting state.

FIGS. 1-5 depict a front perspective view, a first side view, a second side view, a back view, and a bottom view respectively of an example article of headwear 100. In some aspects, the article of headwear 100 includes a crown 110 that may be formed from a polyester material such as, for example, about 70% polyester, about 80% polyester, about 90% polyester, or about 100% polyester. The crown 110 may also include elastomeric yarns such as, for example, spandex or elastane. The article of headwear 100 may optionally include a bill 118 coupled to and extending from the front of the crown 110. The bill 118 may be used when additional protection from the sun is desired. The crown 110 may be divided into general regions for descriptive purposes including a front portion or, more simply, front 105 as shown generally in FIG. 1, a first side 205 shown in FIG. 2, a second side 305 shown in FIG. 3, and a back 405 shown in FIG. 4. The front 105 of the crown may extend across the width of bill 118 from a first bill edge 115 (seen in FIG. 2) to a second bill edge 117 (seen in FIG. 3). The crown 110 also includes an apex 112 positioned at the top of the crown 110 and a lower edge or lower margin 116. In one example aspect, the lower margin 116 of the crown 110 is configured to be positioned above the eyes of the wearer and also above the ears of the wearer, and the apex 112 is configured to be positioned adjacent to the top of the wearer's head. The crown 110 includes a lower portion 114 positioned adjacent (e.g., within about 3 cm to about 8 cm) to the lower margin 116 of the crown 110. The description of the different regions is illustrative only and it is contemplated herein that the different regions may blend into each other without a clear demarcation.

Figure 4:
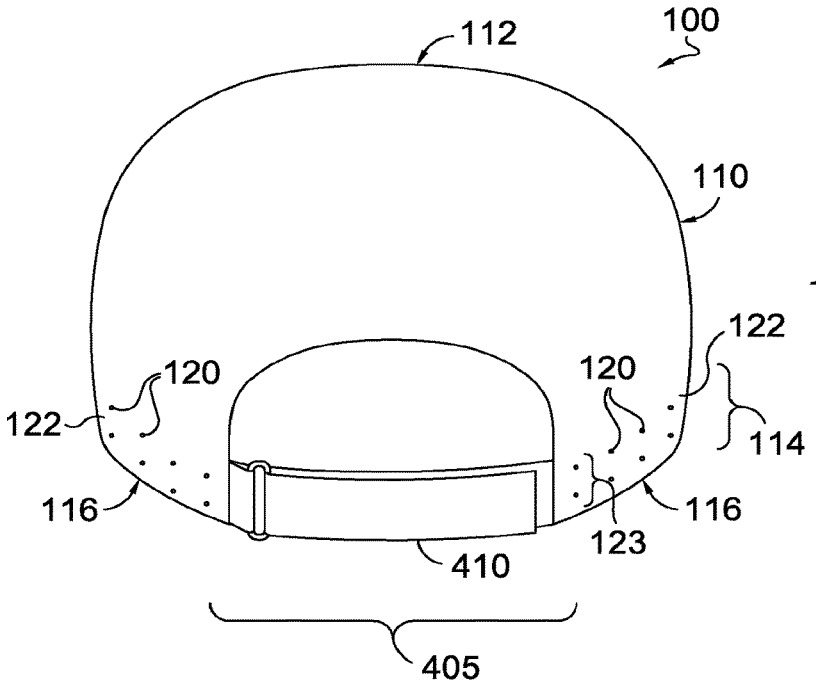
FIG. 4 illustrates a back view of the article of headwear of FIG. 1 in accordance with aspects herein.

FIG. 4 further depicts an optional example strap adjusting mechanism 410 that can be used to adjust the circumference of the article of headwear 100. It is contemplated herein that the article of headwear 100 may not include the strap adjusting mechanism 410. Any and all aspects, and any variation thereof, are contemplated as being within aspects herein.

Figure 5:
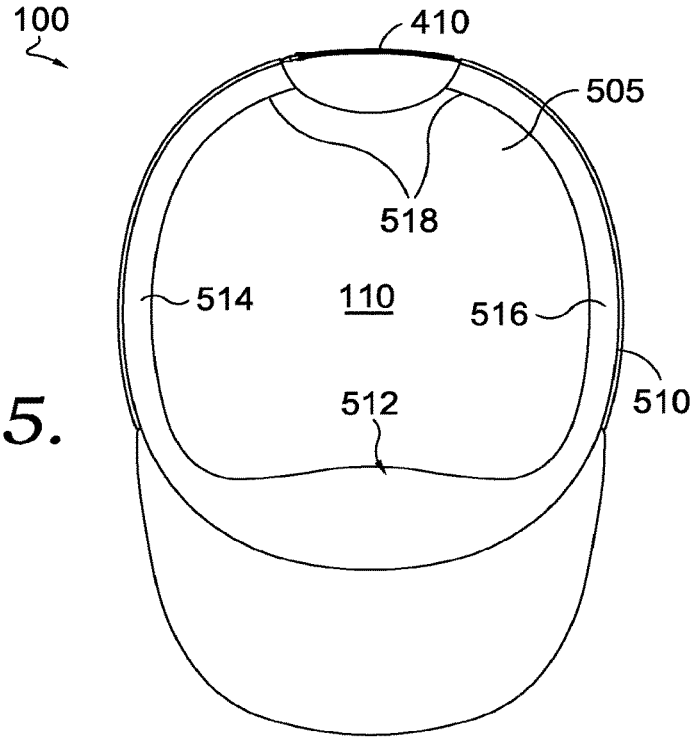
FIG. 5 illustrates a bottom view of the article of headwear of FIG. 1 in accordance with aspects herein.

As shown in FIG. 5, the article of headwear 100 includes an integrated sweatband 510 that extends along the front 105, the first side 205, the second side 305, and the back 405 of the crown 110. The sweatband 510 itself includes a front 512, a first side 514 and a second side 516, and a back 518. The different regions of the sweatband 510 are illustrative only and it is contemplated herein that the different regions may merge into each other without a clear demarcation. The sweatband 510 is secured to an inner-facing surface 505 of the lower portion 114 of the crown 110. The sweatband 510 may be secured using permanent affixing technologies such as stitching, bonding, and adhesive, and the like. In an example aspect, the sweatband 510 may be releasably secured to the crown 110 using, for instance, hook-and-loop fasteners, a releasable adhesive, buttons, snaps and the like. Releasably securing the sweatband 510 to the crown 110 enables the sweatband 510 to be removed and, for instance, washed or replaced and/or for the sweatband 510 to be worn by itself (e.g., as a stand-alone sweatband).

Figure 6:
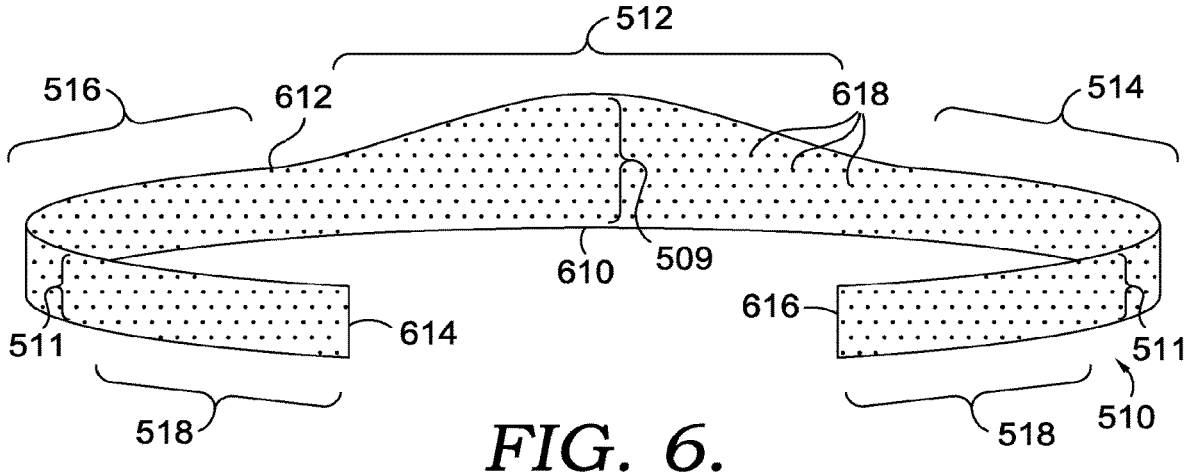
FIG. 6 illustrates an example sweatband configured to be integrated into an article of headwear in accordance with aspects herein.

FIG. 6 depicts a rear-facing view of the sweatband 510 removed from the article of headwear 100. The sweatband 510 includes a lower margin 610, an upper margin 612, a first end 614, and a second end 616. In example aspects, the lower margin 610 of the sweatband 510 may be secured to the lower margin 116 or adjacent to the lower margin 116 of the article of headwear 100 while remaining portions of the sweatband 510 remain detached from the article of headwear 100. In other aspects, both the lower margin 610 and the upper margin 612 of the sweatband 510 may be secured to the article of headwear 100. The configuration shown in FIG. 6 may be used when the article of headwear 100 includes the optional strap adjusting mechanism 410. In some example aspects, the sweatband 510 may have a continuous circumference so that the first end 614 directly extends from the second end 616 to form the continuous circumference (i.e., there is not a space between the first end 614 and the second end 616). This configuration may be used when the article of headwear 100 does not include the strap adjusting mechanism 410. Any and all aspects, and any variation thereof, are contemplated as being within aspects herein. The sweatband 510 may optionally include perforations 618 that extend through the layers forming the sweatband 510.

In example aspects, the front 512 of the sweatband 510 extends a first distance 509 from the lower margin 610, and the first side 514, the second side 516, and the back 518 extend a second distance 511 from the lower margin 610 of the sweatband 510. In example aspects, the first distance 509 is greater than the second distance 511. For example, the front 512 extends from about 5 cm to about 8 cm, from about 5.5 cm to about 7.5 cm, from about 6 cm to about 7 cm, or about 7 cm from the lower margin 610 of the sweatband 510. The first side 514, the second side 516, and the back 518 extend from about 1 cm to about 4.5 cm, from about 2 cm to about 4 cm, from about 3 cm to about 3.5 cm, or about 3.5 cm from the lower margin 610 of the sweatband 510.

Figure 7:
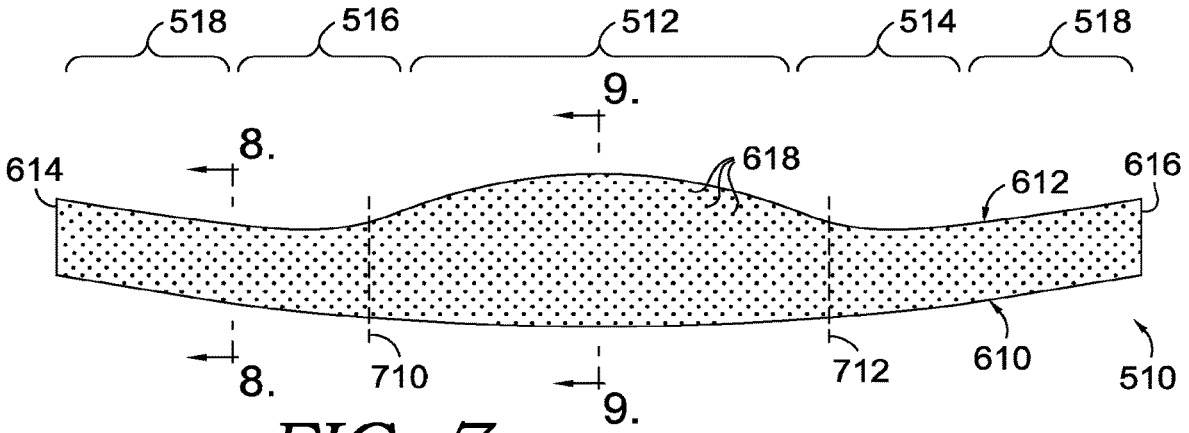
FIG. 7 illustrates the sweatband of FIG. 6 in a laid-flat configuration in accordance with aspects herein.

FIG. 7 depicts the sweatband 510 in a generally laid-flat position. As stated, the sweatband 510 is formed from two layers of material positioned adjacent to each other and extending around the front 512, the first side 514, the second side 516, and the back 518 of the sweatband 510. The sweatband 510 also includes an absorbent material, such as a spacer textile, generally positioned in the area between dashed lines 710 and 712 at a location generally corresponding to the front 512 of the sweatband 510. This location is approximate only, and it is contemplated herein that the absorbent material may extend partially along the first side 514 and/or the second side 516 of the sweatband 510.

Figure 8:
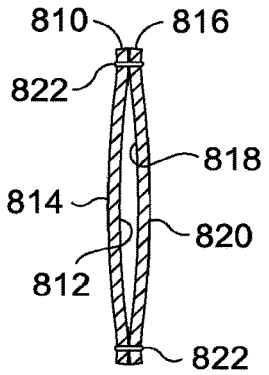
FIG. 8 illustrates a cross-section of the sweatband of FIG. 7 taken along cut line 8-8 in accordance with aspects herein.
Figure 9:
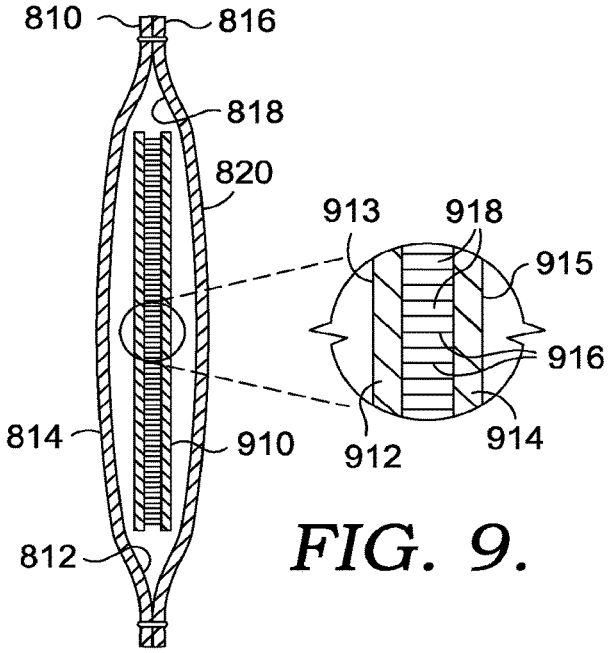
FIG. 9 illustrates a cross-section of the sweatband of FIG. 7 taken along cut line 9-9 in accordance with aspects herein.

FIG. 8 depicts a cross-section of the sweatband 510 taken along cut line 8-8 of FIG. 7, and FIG. 9 depicts a cross-section of the sweatband 510 taken along cut line 9-9 of FIG. 7. The configuration shown in FIG. 8 is located generally along the first side 514, the second side 516 and the back 518 of the sweatband 510, and the configuration shown in FIG. 9 is located generally at the front 512 of the sweatband 510. As seen in FIG. 8, the sweatband 510 includes a first layer of material 810 having a first surface 812 and a second surface 814 opposite the first surface 812. The sweatband 510 also includes a second layer of material 816 having a first surface 818 and a second surface 820 opposite the first surface 818. The first surface 812 of the first layer of material 810 is positioned adjacent to the first surface 818 of the second layer of material 816 (i.e., in face-sharing contact), and, in example aspects, there is a potential space between the first layer of material 810 and the second layer of material 816.

When integrated into the article of headwear 100, the second surface 820 of the second layer of material 816 may be positioned adjacent to a forehead area of a wearer when the article of headwear 100 is worn, and the second surface 814 of the first layer of material 810 may be positioned adjacent to the inner-facing surface 505 of the crown 110. In example aspects, the first layer of material 810 and the second layer of material 816 may be secured together using, for instance, stitching 822 at the upper margin 612 and the lower margin 610 of the sweatband 510. Other securing technologies are contemplated herein such as bonding, spot welding, adhesives, and the like. It is also contemplated herein that the first layer of material 810 and the second layer of material 816 may comprise a single piece of material that is folded and secured at, for example, just the upper margin 612, just the lower margin 610, or at the outer-facing surface or inner-facing surface of the sweatband 510.

In example aspects, both the first layer of material 810 and the second layer of material 816 may be formed from polyester yarns. For instance, the first layer of material 810 and the second layer of material 816 may be about 70% polyester, about 80% polyester, about 90% polyester, or about 100% polyester. The first layer of material 810 and the second layer of material 816 may also include elastomeric yarns such as, for example spandex or elastane. The individual polyester yarns that form the first layer of material 810 and the second layer of material 816 may have a denier from about 30 denier to about 70 denier, from about 40 denier to about 60 denier, from about 45 denier to about 55 denier, or about 50 denier. Each polyester yarn may have from about 40 to about 90 filaments, from about 50 to about 80 filaments, from about 55 to about 75 filaments, or about 72 filaments.

As stated previously, because polyester yarns have a low moisture regain, moisture generally moves through the first layer of material 810 and the second layer of material 816 by capillary action or wicking. Thus, when the second layer of material 816 is positioned adjacent to, for example, the sides of the wearer's head and the back of the wearer's head, and the first layer of material 810 is positioned adjacent to the inner-facing surface 505 of the lower portion 114 of the crown 110, perspiration produced by the wearer travels from the second surface 820 to the first surface 818 of the second layer of material 816, and then from the first surface 812 to the second surface 814 of the first layer of material 810 where it may subsequently evaporate.

FIG. 9 depicts the first layer of material 810 with its first surface 812 and second surface 814, and the second layer of material 816 with its first surface 818 and second surface 820. A spacer textile 910 is shown positioned in the space between the first layer of material 810 and the second layer of material 816. Although depicted as a spacer textile, it is contemplated herein that other absorbent materials may be used such as, for example, cotton, wool, foam, superabsorbent polymers, and the like. In example aspects, the spacer textile 910 may be free floating within the space between the first layer of material 810 and the second layer of material 816. In other aspects, the spacer textile 910 may be secured to one or more of the first layer of material 810 and the second layer of material 816. The spacer textile 910 may be formed from 100% polyester, although it is contemplated herein that the spacer textile 910 may comprise lower percentages of polyester such as about 90% polyester, about 80% polyester, or about 70% polyester. In example aspects, the spacer textile 910 is completely enclosed within the space between the first surface 812 of the first layer of material 810 and the first surface 818 of the second layer of material 816 such that the spacer textile 910 is not exposed or, in other terms, is not visible when viewing the sweatband 510.

As seen in the magnified view of FIG. 9, the spacer textile 910 includes a first layer 912 having a first surface 913 positioned adjacent to the first surface 812 of the first layer of material 810 (i.e., in face-sharing contact). The spacer textile 910 further includes a second layer 914 having a second surface 915 positioned adjacent to the first surface 818 of the second layer of material 816 (i.e., in face-sharing contact). The first layer 912 and the second layer 914 of the spacer textile 910 are interconnected by tie yarns 916. The longitudinal length of the tie yarns 916 extends generally perpendicular, or near perpendicular, to the planar surfaces of the first layer 912 and the second layer 914. The spacer textile 910 includes a plurality of spaces 918 between adjacent tie yarns 916.

When the article of headwear 100 is worn, perspiration produced by the forehead area of the wearer is transported through the second layer of material 816 to the second layer 914 of the spacer textile 910. Because the spacer textile 910 is formed from polyester yarns, the perspiration may be wicked through the second layer 914 to the plurality of spaces 918 between the tie yarns 916. The perspiration may then be temporarily stored within the plurality of spaces 918 increasing the absorbing capacity of the sweatband 510. Perspiration stored within the spacer textile 910 may be further wicked through the first layer 912 of the spacer textile 910 to the first layer of material 810. The perforations 618 extending through, for instance, the first layer of material 810 and/or the second layer of material 816 of the sweatband 510 may facilitate the passage of air into the space between the first layer of material 810 and the second layer of material 816 where the spacer textile 910 is located which may promote the evaporation of perspiration from the spacer textile 910.

Perspiration within the first layer of material 810 and the second layer of material 816 at the front 512 of the sweatband 510 may also be wicked or transported to the first side 514, the second side 516, and/or the back 518 of the sweatband 510 where it may be harmlessly released along the sides and back of the wearer's head and/or may evaporate.

In some aspects the shape of the sweatband may be substantially the same as an optional perforation pattern located on the crown 110 of the article of headwear 100. For example, and with respect to FIGS. 1-4, the crown 110 may optionally include a plurality of perforations 120 that form a perforation pattern (referenced generally by the numeral 122). In general, the plurality of perforations 120 extend along the front 105, the first side 205, the second side 305, and the back 405 of the crown 110. In example aspects, the perforation pattern 122 extends a first height 121 with respect to the lower margin 116 at the front 105 of the crown 110 and a second height 123 with respect to the lower margin 116 at the first side 205, the second side 305, and the back 405 of the crown 110. In example aspects, the first height 121 is greater than the second height 123. For example, the perforation pattern 122 may extend from about 5 cm to about 8 cm, from about 5.5 cm to about 7.5 cm, from about 6 cm to about 7 cm, or about 7 cm from the lower margin 116 at the front 105 of the crown 110 while, at the first side 205 and the second side 305 of the crown 110, the perforation pattern 122 may extend from about 1 cm to about 4.5 cm, from about 2 cm to about 4 cm, from about 3 cm to about 3.5 cm, or about 3.5 cm from the lower margin 116. Similarly, the perforation pattern 122 at the back 405 of the crown 110 extends from about 1 cm to about 4.5 cm, from about 2 cm to about 4 cm, from about 3 cm to about 3.5 cm, or about 3.5 cm from the lower margin 116.

As used herein, the term "substantially the same" when comparing the shape of the sweatband 510 to the perforation pattern 122 means the sweatband 510 and the perforation pattern 122 extend generally the same distance from the respective lower margins of the sweatband 510 and the crown 110 at the front, sides, and back of the respective sweatband 510 and crown 110, that the lower margin 116 of the crown 110 and the lower margin 610 of the sweatband 510 are generally coincident, and that the front, sides and back of the sweatband 510 are aligned with the front, sides, and back of the crown 110. Aligning the perforations 120 with the underlying sweatband 510 helps to channel incoming air directly to the sweatband 510 facilitating evaporation of moisture contained within the sweatband 510. For instance, the optional plurality of perforations 120 at the front 105 of the crown 110 may facilitate the evaporation of the perspiration from, for example, the first layer of material 810, the spacer textile 910, and the second layer of material 816 at the front 512 of the sweatband 510. The optional plurality of perforations 120 at the first side 205, the second side 305, and the back 405 of the crown 110 may facilitate evaporation of perspiration from, for example, the first layer of material 810 and the second layer of material 816 at the first side 514, the second side 516, and the back 518 of the sweatband 510. Additionally, because the crown 110 of the article of headwear 100 is formed from a polyester material, any perspiration that comes into contact with the inner-facing surface 505 of the crown 110 may also be wicked to the outer-facing surface of the crown 110 where it can evaporate.

Figure 10:
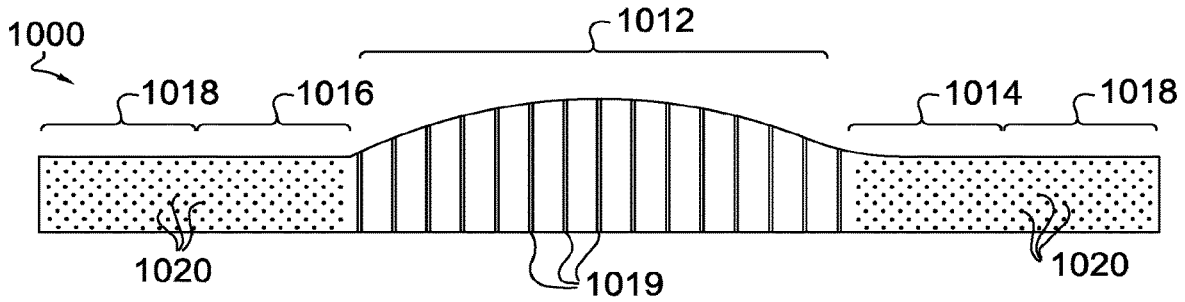
FIG. 10 illustrates an example sweatband in a laid-flat configuration and having a ribbed texture in accordance with aspects herein.

In other aspects, the sweatband may have an optional ribbed texture at the front of the sweatband as shown in FIG. 10. FIG. 10 depicts an example sweatband 1000 that includes features similar to the sweatband 510 including a two-layered construction of polyester material at a first side 1014, a second side 1016, and a back 1018 of the sweatband 1000 and a three-layered construction at a front 1012 of the sweatband 1000 where a spacer textile is positioned between the two layers. In the aspect shown in FIG. 10, the front 1012 of the sweatband 1000 includes a plurality of ribs 1019. The plurality of ribs 1019 may be formed during a knitting process used to form the polyester layers. The plurality of ribs 1019 may be used to create stand-off or, in other terms, a space between a wearer's skin surface and the sweatband 1000 at the front 1012 of the sweatband 1000. Similar to the sweatband 510, the sweatband 1000 may optionally include perforations 1020 along the first side 1014, the second side 1016, and the back 1018 of the sweatband 1000.

Figure 11:
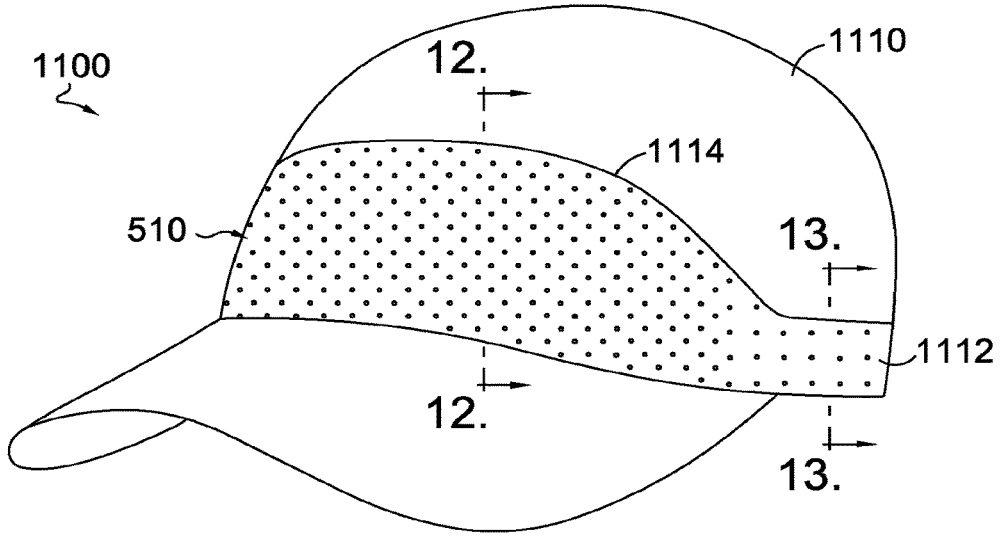
FIG. 11 illustrates a front perspective view of an example article of headwear having an integrated sweatband in accordance with aspects herein.

In other aspects, the sweatband may be integrated directly into the crown of the article of headwear, as opposed to the sweatband being a separate component secured to an inner-facing surface of the article of headwear. FIG. 11 depicts this aspect and illustrates an article of headwear 1100 having an upper crown portion 1110 and a lower crown portion 1112. The upper crown portion 1110 may, in example aspects, be formed of a single layer of material including a polyester material. The lower crown portion 1112 may be formed from, for instance, the sweatband 510. Thus, instead of the sweatband 510 being secured to a lower portion of an inner-facing surface of the crown as described for the article of headwear 100, the sweatband 510 may form the lower crown portion 1112 and be secured to the upper crown portion 1110 along seam line 1114. The sweatband 510 may be secured to the upper crown portion 1110 along the seam line 1114 by, for example, stitching, adhesives, bonding, seam tape, and the like.

Figure 12:
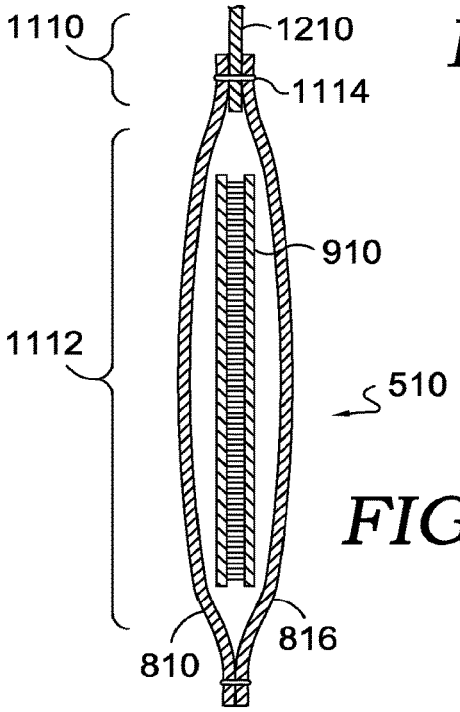
FIG. 12 illustrates a cross-section taken along cut line 12-12 of FIG. 11 in accordance with aspects herein.
Figure 13:
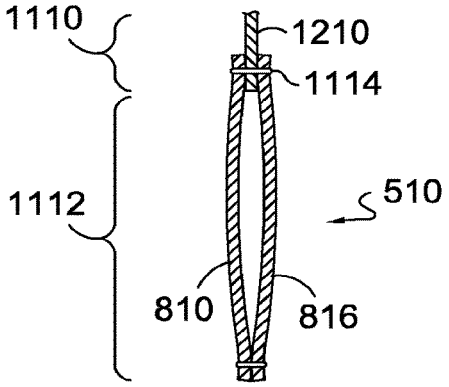
FIG. 13 illustrates a cross-section taken along cut line 13-13 of FIG. 11 in accordance with aspects herein.

FIG. 12 depicts a cross-section of the article of headwear 1100 taken along cut line 12-12 at the front of the article of headwear 1100, and FIG. 13 depicts a cross-section of the article of headwear 1100 taken along cut line 13-13 at the side of the article of headwear 1100. FIG. 12 depicts a single layer of material 1210 forming the upper crown portion 1110. In example aspects, the single layer of material 1210 may comprise a polyester material although other materials are contemplated herein. The lower crown portion 1112 includes the first layer of material 810 of the sweatband 510, the second layer of material 816 of the sweatband 510, and the spacer textile 910 positioned between the first layer of material 810 and the second layer of material 816. The sweatband 510 and the upper crown portion 1110 are joined at the seam line 1114.

FIG. 13 depicts the single layer of material 1210 forming the upper crown portion 1110. The lower crown portion 1112 at the sides and back of the article of headwear 1100 includes the first layer of material 810 of the sweatband 510 and the second layer of material 816 of the sweatband 510 without the spacer textile 910. The sweatband 510 and the upper crown portion 1110 are joined at the seam line 1114.

The article of headwear 1100 transports perspiration in a somewhat similar way to the article of headwear 100. For instance, when the article of headwear 1100 is worn, perspiration produced by the forehead area of the wearer is transported through the second layer of material 816 to the spacer textile 910. Because the spacer textile 910 is formed from polyester yarns, the perspiration may be wicked to the spaces formed between the tie yarns of the spacer textile 910. The perspiration may then be temporarily stored within the spaces before being further wicked through the spacer textile 910 to the first layer of material 810. Since the first layer of material 810 is in contact with the environment in the aspect shown in FIGS. 11-13, air from the environment may facilitate evaporation of perspiration from the first layer of material 810. Because the upper crown portion 1110 is formed from a polyester material, perspiration may be further wicked to the upper crown portion 1110 where it may spread out and potentially evaporate.

Perspiration within the first layer of material 810 and the second layer of material 816 at the front of the sweatband 510 may also be wicked or transported to the sides and back of the sweatband 510 where it may be harmlessly released along the sides and back of the wearer's head or it may evaporate due to exposure to air in the external environment. Additionally, perspiration may be further wicked to the upper crown portion 1110 where it may spread out and potentially evaporate.

Figure 14:
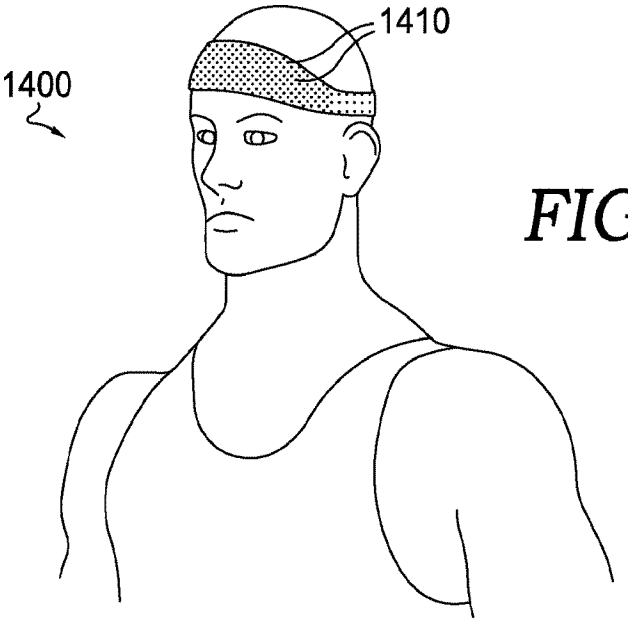
FIG. 14 illustrates a stand-alone sweatband being worn by a wearer in accordance with aspects herein.

The sweatband discussed herein, such as the sweatband 510 or the sweatband 1000, may be worn as a stand-alone sweatband as illustrated in FIG. 14. FIG. 14 depicts a sweatband 1400 being worn on the head of a wearer. In example aspects, the sweatband 1400 may comprise a continuous circumference or band as shown. In other aspects, the sweatband 1400 may have a first end and a second end that may, for example, be tied at the back of the wearer's head. The sweatband 1400 has similar features as the sweatband 510 or the sweatband 1000. As such, a cross-section taken along the sides and the back of the sweatband 1400 would be similar to the cross-section shown in FIG. 8, and a cross-section taken at the front of the sweatband 1400 would be similar to the cross-section shown in FIG. 9. The sweatband 1400 may include optional perforations 1410 in the first layer of material and/or the second layer of material.

Figure 15B:
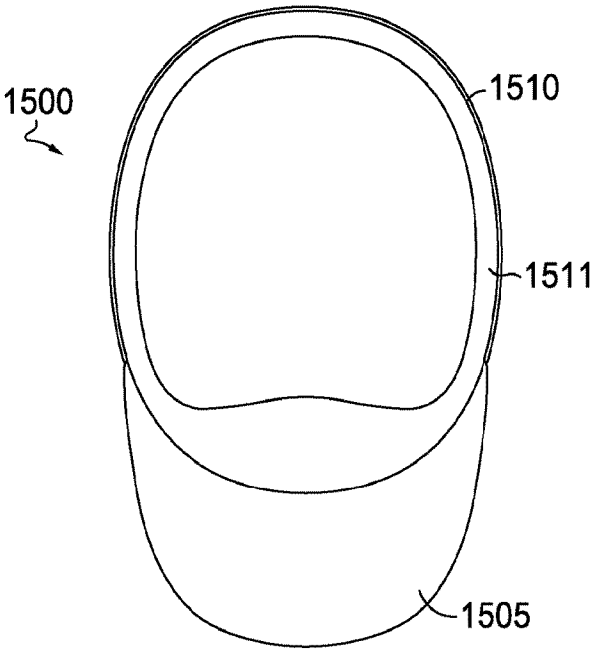
FIG. 15B illustrates a bottom view of the article of headwear of FIG. 15A in accordance with aspects herein.
Figure 15A:
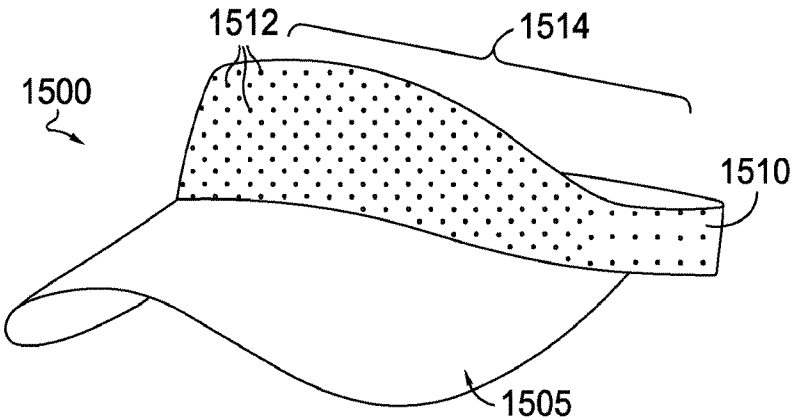
FIG. 15A illustrates a front perspective view of an example article of headwear in the form of a visor having an integrated sweatband in accordance with aspects herein.

FIGS. 15A and 15B depict a front perspective view and a bottom view respectively of another example article of headwear 1500 in the form of a visor with a bill 1505. In one example aspect, the article of headwear 1500 may comprise a construction similar to the article of headwear 100 (without the crown 110) such that the article of headwear 1500 includes a band portion 1510 configured to encircle a head of a wearer and an integrated sweatband 1511 that is secured to an inner-facing surface of the band portion 1510 (shown in FIG. 15B). The integrated sweatband 1511 would have a similar construction as the sweatband 510 or the sweatband 1000 and cross-sections of the sweatband 1511 would be similar to the cross-sections shown in FIGS. 8 and 9. The sweatband 1511 may optionally include perforations such as the perforations 618 of the sweatband 510 or the perforations 1020 of the sweatband 1000.

The band portion 1510 of the article of headwear 1500 may also optionally have a plurality of perforations 1512 forming a perforation pattern 1514. Similar to the article of headwear 100, the shape of the sweatband 1511 may be substantially the same as the perforation pattern 1514 on the band portion 1510 such that the front of the sweatband 1511 and the front of the perforation pattern 1514 extend higher than the sides and the back of the respective sweatband 1511 and perforation pattern 1514 with respect to a lower margin of the article of headwear 1500.

In another example aspect, the band portion of the article of headwear 1500 may comprise just the sweatband 1511 such that an outer-facing surface of the sweatband 1511 is configured to face an external environment and an inner-facing surface of the sweatband 1511 is configured to face a skin surface of a wearer. In this aspect, the bill 1505 would be affixed directly to the sweatband 1511.

The articles of headwear shown in FIG. 14 and FIGS. 15A-15B would function similar to the articles of headwear 100 and 1100. For example, when the sweatband 1400 and the article of headwear 1500 are worn, perspiration produced by the forehead area of the wearer is transported through the second layer of material of the sweatbands 1400 and 1511 respectively to the spacer textile positioned between the two layers of material. Because the spacer textile is formed from polyester yarns, the perspiration may be wicked at least partially through the spacer textile to the plurality of spaces between the tie yarns. The perspiration may then be temporarily stored within the plurality of spaces increasing the absorbing capacity of the sweatbands 1400 and 1511. Perspiration stored within the spacer textile may be further wicked through the spacer textile to the first layer of material of the sweatbands 1400 and 1511.

Perspiration within the first layer of material and/or the second layer of material at the front of the sweatbands 1400 and 1511 may also be wicked or transported to the sides and back of the sweatbands 1400 and 1511 where it may be harmlessly released along the sides and back of the wearer's head and/or may evaporate.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are illustrative in nature and are not limiting.

Clause 1. An article of headwear comprising:

a crown having a plurality of perforations arranged in a perforation pattern on a lower portion of the crown, the perforation pattern extending along a front, sides, and a back of the crown; and a sweatband including one or more layers formed from a polyester yarn, the sweatband secured to an inner-facing surface of the lower portion of the crown and extending along the front, the sides, and the back of the crown, the sweatband having a shape that is substantially the same as the perforation pattern.

Clause 2. The article of headwear according to clause 1, wherein the perforation pattern extends farther superiorly along the front of the crown than along the sides and the back of the crown.

Clause 3. The article of headwear according to any of clauses 1 through 2, wherein a front of the sweatband extends farther superiorly than sides and a back of the sweatband.

Clause 4. The article of headwear according to any of clauses 1 through 3, wherein the sweatband comprises a first layer of material extending along the front, the sides, and the back of the sweatband and a second layer of material extending along the front, the sides, and the back of the sweatband.

Clause 5. The article of headwear according to clause 4, wherein the sweatband further comprises a spacer textile positioned between the first layer of material and the second layer of material at the front of the sweatband.

Clause 6. The article of headwear according to clause 5, wherein the spacer textile does not extend along the sides and the back of the sweatband.

Clause 7. The article of headwear according to any of clauses 5 through 6, wherein the spacer textile includes a first surface positioned adjacent to the first layer of material and a second surface positioned adjacent to the second layer of material so that the first surface and the second surface of the spacer textile are not exposed.

Clause 8. The article of headwear according to any of clauses 1 through 7, wherein the sweatband includes a second plurality of perforations.

Clause 9. An article of headwear comprising:

a crown; and a sweatband secured to an inner-facing surface of a lower portion of the crown and extending along a front, sides, and a back of the crown, the sweatband including:

a first layer of material formed from a polyester yarn and extending along a front, sides, and a back of the sweatband;

a second layer of material formed from a polyester yarn and extending along the front, the sides, and the back of the sweatband; and a spacer textile positioned between the first layer of material and the second layer of material at the front of the sweatband, wherein the spacer textile does not extend along the sides and the back of the sweatband.

Clause 10. The article of headwear according to clause 9, wherein the spacer textile includes a first surface positioned adjacent to the first layer of material and a second surface positioned adjacent to the second layer of material.

Clause 11. The article of headwear according to any of clauses 9 through 10, wherein the spacer textile is completely enclosed between the first layer of material and the second layer of material.

Clause 12. The article of headwear according to any of clauses 9 through 11, wherein the crown comprises a plurality of perforations arranged in a perforation pattern on the lower portion of the crown, the perforation pattern extending along the front, the sides, and the back of the crown.

Clause 13. The article of headwear according to clause 12, wherein the perforation pattern extends farther superiorly on the front of the crown than along the sides and the back of the crown.

Clause 14. The article of headwear according to any of clauses 12 through 13, wherein the sweatband has a shape that is substantially the same as the perforation pattern.

Clause 15. The article of headwear according to any of clauses 9 through 14, wherein the sweatband comprises a plurality of perforations along the front, the sides, and the back of the sweatband.

Clause 16. An article of headwear comprising:

a crown having a plurality of perforations arranged in a perforation pattern on a lower portion of the crown, the perforation pattern extending along a front, sides, and a back of the crown; and a sweatband secured to an inner-facing surface of the lower portion of the crown and extending along the front, the sides, and the back of the crown, the sweatband having a shape that is substantially the same as the perforation pattern, wherein the sweatband includes a first layer of material and a second layer of material that extend along a front, sides, and a back of the sweatband, and where the sweatband further includes a spacer textile positioned between the first layer of material and the second layer of material at the front of the sweatband.

Clause 17. The article of headwear according to clause 16, wherein the spacer textile does not extend along the sides and the back of the sweatband.

Clause 18. The article of headwear according to any of clauses 16 through 17, wherein the perforation pattern extends farther superiorly on the front of the crown than the sides and the back of the crown.

Clause 19. The article of headwear according to any of clauses 16 through 18, wherein the spacer textile is completely enclosed between the first layer of material and the second layer of material.

Clause 20. The article of headwear according to any of clauses 16 through 19, wherein the first layer of material and the second layer of material are formed from a polyester yarn.

Clause 21. The article of headwear according to any of clauses 16 through 20, wherein the first layer of material and the second layer of material of the sweatband comprise a second plurality of perforations.

Clause 22. The article of headwear according to any of clauses 16 through 21, wherein one or more of the first layer of material and the second layer of material include a ribbed texture at the front of the sweatband.

Clause 23. An article of headwear comprising:

an upper crown portion formed from a single layer of material; and a lower crown portion formed from a first layer of material and a second layer of material that extend along a front, sides, and a back of the crown, wherein a spacer textile is positioned between the first layer of material and the second layer of material at the front of the lower crown portion.

Clause 24. The article of headwear according to clause 23, wherein the lower crown portion is secured to the upper crown portion at a seam line.

Clause 25. The article of headwear according to any of clauses 23 through 24, wherein one or more of the first layer of material and the second layer of material include a plurality of perforations.

Clause 26. The article of headwear according to any of clauses 23 through 25, wherein the first layer of material and the second layer of material are formed from a polyester yarn.

Clause 27. The article of headwear according to any of clauses 23 through 26, wherein the single layer of material is formed from a polyester yarn.

Clause 28. An article of headwear comprising:

a first layer of material formed from a polyester yarn and configured to face a wearer when the article of headwear is in an as-worn configuration;

a second layer of material formed from a polyester yarn; and an absorbent layer in face-sharing contact with and positioned between the first layer of material and the second layer of material, the absorbent layer spanning only a front portion of the article of headwear, wherein along sides and a back of the article of headwear, the first layer of material and the second layer of material are in face-sharing contact with one another.

Clause 29. The article of headwear according to clause 28, further comprising a crown, wherein the first layer of material, the absorbent layer, and the second layer of material form a sweatband secured to an inner-facing surface of a lower portion of the crown.

Clause 30. The article of headwear according to any of clauses 28 through 29, wherein a front of the sweatband extends a first distance with respect to a lower margin of the sweatband, wherein sides and a back of the sweatband extend a second distance with respect to the lower margin of the sweatband, and wherein the first distance is greater than the second distance.

Clause 31. The article of headwear according to any of clauses 28 through 30, wherein the first layer of material is a continuous and uninterrupted layer extending along the front, the sides, and the back of the article of headwear, and the second layer of material is a continuous and uninterrupted layer extending along the front, the sides, and the back of the article of headwear.

Clause 32. The article of headwear according to any of clauses 28 through 31, wherein the absorbent layer is a spacer textile.

Clause 33. The article of headwear according to clause 32, wherein the spacer textile includes a first surface positioned adjacent to the first layer of material and a second surface positioned adjacent to the second layer of material so that the first surface and the second surface of the spacer textile are not exposed.

Clause 33. The article of headwear according to any of clauses 28 through 32, wherein at least one or more of the first layer of material, the absorbent layer, and the second layer of material includes a plurality of perforations.

Clause 34. An article of headwear comprising:

a sweatband secured to an inner-facing surface of a lower portion of the article of headwear and extending along a front, sides, and a back of the article of headwear, the sweatband including:

a first layer of material formed from a polyester yarn and extending along a front, sides, and a back of the sweatband;

a second layer of material formed from a polyester yarn and extending along the front, the sides, and the back of the sweatband; and an absorbent layer positioned between and in face-sharing contact with the first layer of material and the second layer of material at the front of the sweatband, wherein along the sides and the back of the article of headwear, the first layer of material and the second layer of material are in face-sharing contact with one another.

Clause 35. The article of headwear according to clause 34, wherein the absorbent layer includes a first surface positioned adjacent to the first layer of material and a second surface positioned adjacent to the second layer of material.

Clause 36. The article of headwear according to any of clauses 34 through 35, wherein the absorbent layer is completely enclosed between the first layer of material and the second layer of material.

Clause 37. The article of headwear according to any of clauses 34 through 36, wherein the article of headwear further comprises a plurality of perforations arranged in a perforation pattern on the lower portion of the article of headwear, the perforation pattern extending along the front, the sides, and the back of the article of headwear.

Clause 38. The article of headwear according to clause 37, wherein the perforation pattern extends a first distance with respect to a lower margin of the article of headwear at the front of the article of headwear, wherein the perforation pattern extends a second distance with respect to the lower margin of the article of headwear at the sides and the back of the article of headwear, and wherein the first distance is greater than the second distance.

Clause 39. The article of headwear according to any of clauses 37 through 38, wherein the sweatband has a shape that is substantially the same as the perforation pattern.

Clause 40. The article of headwear according to any of clauses 34 through 39, wherein the sweatband comprises a plurality of perforations along the front, the sides, and the back of the sweatband.

Clause 41. An article of headwear comprising:

a crown having a plurality of perforations arranged in a perforation pattern on a lower portion of the crown, the perforation pattern extending along a front, sides, and a back of the crown; and a sweatband secured to an inner-facing surface of the lower portion of the crown and extending along the front, the sides, and the back of the crown, the sweatband having a shape that is substantially the same as the perforation pattern, wherein the sweatband includes a first layer of material and a second layer of material that extend along a front, sides, and a back of the sweatband, and wherein the sweatband further includes an absorbent layer in face-sharing contact with and positioned between the first layer of material and the second layer of material at the front of the sweatband.

Clause 42. The article of headwear according to clause 41, wherein the absorbent layer is located at the front of the sweatband and does not extend along the sides and the back of the sweatband.

Clause 43. The article of headwear according to any of clauses 41 through 42, wherein the perforation pattern extends a first distance with respect to a lower margin of the crown at the front of the article of headwear, wherein the perforation pattern extends a second distance with respect to the lower margin of the crown at the sides and the back of the article of headwear, and wherein the first distance is greater than the second distance.

Clause 44. The article of headwear according to any of clauses 41 through 43, wherein the absorbent layer is completely enclosed between the first layer of material and the second layer of material.

Clause 45. The article of headwear according to any of clauses 41 through 44, wherein the first layer of material and the second layer of material are formed from a polyester yarn.

Clause 46. The article of headwear according to any of clauses 41 through 45, wherein the absorbent material is formed from a polyester yarn.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. An article of headwear comprising:

a first layer of material comprising a first upper edge and a first lower edge, the first layer of material comprising an outermost wall of the article of headwear;

a second layer of material comprising a second upper edge and a second lower edge, the second layer of material comprising an innermost wall of the article of headwear, wherein the first upper edge and the second upper edge are secured together at an upper seam, and the first lower edge and the second lower edge are secured together at a lower seam, the upper seam and the lower seam each extending entirely around a continuous circumference of the article of headwear;

wherein an absorbent material is positioned between the first layer of material and the second layer of material, the absorbent material being retained between the first and second layers by the upper and lower seams;

wherein the article of headwear comprises a front, sides, and a back;

wherein the absorbent material does not extend along the sides and back of the article of headwear; and wherein a bill is affixed to a lower margin of the article of headwear.

2. The article of headwear of claim 1, wherein an upper edge of the front is spaced a first distance from the lower margin of the article of headwear, an upper edge of the sides is spaced a second distance from the lower margin of the article of headwear, and the first distance is larger than the second distance.

3. The article of headwear of claim 1, wherein one or more of the first layer of material and the second layer of material include a plurality of perforations forming a perforation pattern.

4. The article of headwear of claim 3, wherein the perforation pattern extends a first distance with respect to the lower margin of the article of headwear at the front of the article of headwear, wherein the perforation pattern extends a second distance with respect to the lower margin of the article of headwear at the sides and the back of the article of headwear, and wherein the first distance is greater than the second distance.

5. The article of headwear of claim 1, wherein the first layer of material and the second layer of material are formed from polyester yarns.

6. The article of headwear of claim 1, wherein the absorbent material is completely surrounded by the first layer of material and the second layer of material.

7. The article of headwear of claim 1, wherein the absorbent material is a spacer textile.

8. The article of headwear of claim 7, wherein the spacer textile includes a first surface positioned adjacent to the first layer of material and a second surface positioned adjacent to the second layer of material so that the first surface and the second surface of the spacer textile are not visible to an observer viewing an exterior of the article of headwear.

9. An article of headwear comprising:

a first layer of material comprising a first upper edge and a first lower edge, the first layer of material configured to face a wearer when the article of headwear is in an as-worn configuration;

a second layer of material comprising a second upper edge and a second lower edge;

wherein the first upper edge and the second upper edge are secured together at an upper seam and the first lower edge and the second lower edge are secured together at a lower seam, the upper seam and the lower seam each extending entirely around a continuous circumference of the article of headwear;

an absorbent layer positioned between the first layer of material and the second layer of material, the absorbent layer spanning only a front of the article of headwear, and retained between the first and second layers by the upper and lower seams, the absorbent layer being in direct contact with one or more of the first layer of material and the second layer of material;

wherein along sides and a back of the article of headwear, the first layer of material and the second layer of material are in face-sharing contact with one another; and a bill affixed to a lower margin of the article of headwear.

10. The article of headwear of claim 9, wherein the first layer of material is a continuous and uninterrupted layer extending along the front, the sides, and the back of the article of headwear, and the second layer of material is a continuous and uninterrupted layer extending along the front, the sides, and the back of the article of headwear.

11. The article of headwear of claim 9, wherein the absorbent layer is a spacer textile.

12. The article of headwear of claim 11, wherein the spacer textile includes a first surface positioned adjacent to the first layer of material and a second surface positioned adjacent to the second layer of material so that the first surface and the second surface of the spacer textile are not visible to an observer viewing an exterior of the article of headwear.

13. The article of headwear of claim 9, wherein one or more of the first layer of material and the second layer of material include a plurality of perforations forming a perforation pattern.

14. The article of headwear of claim 13, wherein the perforation pattern extends a first distance with respect to the lower margin of the article of headwear at the front of the article of headwear, wherein the perforation pattern extends a second distance with respect to the lower margin of the article of headwear at the sides and the back of the article of headwear, and wherein the first distance is greater than the second distance.

15. An article of headwear comprising:

a sweatband, comprising:

a first layer of material configured to face a wearer when the article of headwear is in an as-worn configuration;

a second layer of material defining an outer-most surface of the article of headwear;

an absorbent layer surrounded by the first layer of material and the second layer of material and held in place by an upper seam at an upper margin of the sweatband and a lower seam at a lower margin of the sweatband, the upper seam and the lower seam each extending entirely around a continuous circumference of the sweatband; and a bill extending from the sweatband, wherein the article of headwear comprises a front, sides, and a back, and wherein the absorbent layer does not extend along the sides and back of the article of headwear.

16. The article of headwear of claim 15, wherein the first layer of material is a continuous and uninterrupted layer extending along the front, the sides, and the back of the article of headwear, and the second layer of material is a continuous and uninterrupted layer extending along the front, the sides, and the back of the article of headwear.

17. The article of headwear of claim 15, wherein the absorbent layer is a spacer textile.

18. The article of headwear of claim 17, wherein the spacer textile includes a first surface positioned adjacent to the first layer of material and a second surface positioned adjacent to the second layer of material so that the first surface and the second surface of the spacer textile are not visible to an observer viewing an exterior of the article of headwear.

19. The article of headwear of claim 15, wherein one or more of the first layer of material and the second layer of material include a plurality of perforations.

* * * * *